US006112773A

United States Patent [19]

Geiger

[11] Patent Number: 6,112,773

[45] Date of Patent: Sep. 5, 2000

[54] METHOD AND LOOM FOR WEAVING FIRST AND/OR SECOND PILE LENGTHS WHILE WEAVING TERRY FABRIC

[75] Inventor: Erwin Geiger, Lindau, Germany

[73] Assignee: Lindauer Dornier Gesellschaft mbH, Lindau, Germany

[21] Appl. No.: 09/373,498

[22] Filed: Aug. 12, 1999

[30] Foreign Application Priority Data

Aug. 12, 1998 [DE] Germany ..... 198 36 453

[51] Int. Cl.[7] ..... D03D 39/22

[52] U.S. Cl. ..... 139/26

[58] Field of Search ..... 139/26, 25

[56] References Cited

U.S. PATENT DOCUMENTS

| | | | |
|---|---|---|---|
| 1,739,205 | 12/1929 | Blanchard . | |
| 4,294,290 | 10/1981 | Freisler | 139/26 |
| 4,721,134 | 1/1988 | Dorman et al. . | |
| 5,392,817 | 2/1995 | Seifert et al. | 139/25 |
| 5,499,662 | 3/1996 | Vogel et al. | 139/26 |
| 5,518,037 | 5/1996 | Takahashi et al. . | |
| 5,722,465 | 3/1998 | Herrlein | 139/25 |

FOREIGN PATENT DOCUMENTS

| | | |
|---|---|---|
| 0518809 | 12/1992 | European Pat. Off. . |
| 0768407 | 4/1997 | European Pat. Off. . |
| 7-145534 | 6/1995 | Japan . |

*Primary Examiner*—Andy Falik
*Attorney, Agent, or Firm*—W. F. Fasse; W. G. Fasse

[57] ABSTRACT

Two different pile heights (a, b) can be selectively formed during the weaving of terry fabric on a loom by shifting the fabric with its actual beat-up line (10*a*) back and forth relative to a base beat-up line (3). First and second fabric shifting oscillating motions are performed by first and second power or motion transmission couplings (4, 11) driven through eccentric drives (5, 12) from a main loom drive shaft (DS) and controlled through valves by a central loom control (22) in such a way that a second oscillation with a different amplitude is superimposed on a first oscillation between beat-up groups of weft beat-up motions including partial weft beat-ups and a full weft beat-up motion of a reed (2) in the loom. Different oscillation amplitudes cause a beat-up line shift of different length (a or b) whereby different pile heights are formed.

15 Claims, 2 Drawing Sheets

METHOD AND LOOM FOR WEAVING FIRST AND/OR SECOND PILE LENGTHS WHILE WEAVING TERRY FABRIC

This application is based on and claims the priority under 35 U.S.C. §119 of German Patent Application 198 36 453.9-26, filed on Aug. 12, 1999.

FIELD OF THE INVENTION

The invention relates to a method for the formation of one and/or two different pile lengths while weaving terry fabric. The invention also relates to a weaving loom for performing the method whereby the formation or control of the different pile lengths is accomplished by a so-called cloth or fabric shifting.

BACKGROUND INFORMATION

Methods for varying the pile height or pile lengths while weaving terry fabric and looms for performing such methods are known in the art. These methods and devices employ the principle of so-called fabric shifting. The following publications describe this principle, European Patent Publication EP 0,518,809 A1; Japanese Patent Publication JP 07-145534; U.S. Pat. No. 5,518,037 and European Patent Publication 0,768,407 A1. Looms equipped with conventional devices for the varying of the pile height or length as described in the above references include pile height adjustment mechanisms which are controllable independently of the main drive of the loom. Such devices require a substantial effort and expense for their construction and for accomplishing their function.

A known terry fabric weaving loom has a rotatably supported fabric take up roller with a reed which performs in a repetitive motion rhythm weft thread partial beat-ups and a weft thread full beat-up. A number of partial beat-ups and at least one full beat-up form a group of beat-ups. The pile height formation mechanism includes a motion transmission coupling, the drive of which is derived from the main loom drive and may be blocked. The drive connection to the main loom drive is accomplished by an eccentric cam drive. Coupling elements transmit the drive of the eccentric cam to the fabric take-up roller for shifting the actual beat-up line of the fabric relative to a base beat-up line in the loom. Such a machine is capable of forming either a smooth fabric or a fabric with one pile height. Varying the pile height or length is not possible.

OBJECTS OF THE INVENTION

In view of the above, it is the aim of the invention to achieve the following objects singly or in combination:

- to provide a method and weaving loom for producing terry fabric that has, in addition to a first pile height or length at least one second pile height or length that differs from the first pile height or length, whereby it shall also be possible to weave smooth fabric sections if desired;
- to improve the principle of fabric shifting in the formation of more than one pile height or length;
- to control the formation of both pile heights and their length through a central loom control; and
- to derive the drive for the formation of two different pile heights or lengths from the main drive shaft of the loom by superimposing one oscillating back and forth motion on an other oscillating back and forth motion.

SUMMARY OF THE INVENTION

According to the invention there is provided a method for weaving terry fabric having selectively first and/or second different pile lengths, comprising the following steps:

(a) performing a first weaving motion sequence of first weaving steps including weft thread beat-up motions;

(b) first shifting a movable weft beat-up line (10*a*) of said terry fabric (10) during said first motion sequence by imposing first oscillating back and forth motions on said terry fabric (10) relative to a beat-up base line (3) between said first weaving steps;

(c) controlling an amplitude of said first oscillating back and forth motions to form a first shifting length (a) which provides a respective first pile length;

(d) performing a second weaving motion sequence of second weaving steps including weft thread beat-up motions;

(e) second shifting said movable weft beat-up line (10*a*) of said terry fabric (10) by imposing second oscillating back and forth motions on said terry fabric (10) relative to said beat-up base line (3) between said second weaving steps;

(f) further controlling an amplitude of said second oscillating back and forth motions to form a second shifting length (b) which provides a respective second pile length; and (g) superimposing said second weaving motion sequence on said first weaving motion sequence for producing said two different pile lengths (a and/or b).

According to the invention there is further provided a loom for the performance of the present method, whereby the loom is characterized by the combination of the following features, a main loom drive shaft (DS), a rotatably mounted fabric take-up roller (1), a reed (2) for performing full and partial weft beat-up motions, a first motion transmission coupling (4), a first eccentric cam drive (5) driven through said main loom drive shaft (DS) and operatively connected to said first motion transmission coupling (4), first coupling links (7, 8, 9) linking said first motion transmission coupling (4) to said take-up roller (1) for shifting a weft beat-up line (10*a*) of said terry fabric (10) relative to a base beat-up line (3) back and forth by a first length (a) which provides a respective first pile length, said apparatus further comprising a second motion transmission coupling (11), a second eccentric cam drive (12) driven through said main loom drive shaft (DS) and operatively connected to said second motion transmission coupling (11), a motion superimposing mechanism comprising second coupling links (14, 15, 16) linking said second motion transmission coupling (11) to said first power transmission coupling (4) for superimposing motions of said second motion transmission coupling (11) on motions of said first motion transmission coupling (4) so that said fabric take-up roller (1) shifts said beat-up line (10*a*) relative to said base beat-up line (3) back and forth by a second length (b) which provides a respective different pile length when said first and second power transmission couplings are actively driven by said first and second eccentric cam drives (5, 12).

Generally one or the other pile height or length may be larger. However, it is preferred that the first formed pile height or length (a) is larger than the second formed pile height or length (b), whereby the first motion transmission coupling (4) realizes the formation of a larger pile length (a) than the second motion transmission coupling (11). The basis for achieving a pile length (a) larger than the pile length (b) resides in the fact that certain pivot or journal points or axis of the couplings are effective for both motion transmission couplings (4 and 11) in a motion superimposing mechanism (16) that links both power transmission couplings (4 and 11) so that both couplings are effective through the superimposing mechanism (16).

Two different radial on-center lengths (L and L') are established on the coupling plate (16*d*) of the superimposing mechanism (16) by fixing respective pivot or journal points. A radial on-center spacing corresponding to the length (L) is established on the coupling plate (16*d*) between the journal axis (7*a*) of a first coupling link (7) of the first motion transmission coupling (4) and an input journal axle (16*c*) for applying the oscillating motion of the second motion transmission coupling (11). The axis (16*c*') of the input journal axle (16*c*) is radially spaced from a fixed journal axis (16") by the spacing (L'). The components are so dimensioned that (L') is smaller than (L) for making sure that the first formed pile length (a) is larger than the second pile length (b).

Due to the above described fixed on-center spacings (L) and (L') the amplitude or fabric shifting length of the actual beat-up line (10*a*) having the length "a" is reduced to the length "b" when the second motion transmission coupling (11) is activated. This reduction of the shifting amplitude from (a) to (b) is accomplished according to the invention by superimposing the motion of the second motion transmission coupling (11) on the first motion by a crank (15) that is rigidly secured to a rotatably mounted journal axle (16*a*) which in turn carries a further crank arm (16*b*) journalled with its free end at (16*c*) to the coupling plate (16*d*). The second motion shifts the position of the coupling plate (16*d*), whereby the second motion is superimposed on the first motion thereby transmitting both motions through the coupling plate (16*d*). The oscillating second amplitude reduces the length (a) of the first amplitude of the first motion to the shorter length (a) to the shorter length (b) of the combined motions.

If both power transmission couplings are blocked by a respective blocking mechanism in accordance with a pattern program stored in the memory of the loom control (22), then the loom will weave a so-called smooth fabric. During the weaving of terry fabric so-called borders are formed during a smooth weaving operation.

By employing in the present loom the blocking mechanisms the operator has the choice of weaving smooth fabric, or terry fabric with one pile height or terry fabric with two different pile heights.

An important feature of the invention is the motion superimposing mechanism which is characterized by a fixed bearing support (BS), an axle (16*a*) journalled in said fixed bearing support, a crank (15) rigidly secured to said axle (16*a*) and articulated at its other end to said second coupling line (14), a first lever arm (16*b*) having a first end rigidly secured to said axle (16*a*), a coupling plate (16*d*), a journal (16*c*) pivoting said lever arm (16*b*) to said coupling plate (16*d*), and further journals (7*a*, 8*a*) journalling said first coupling links (7, 8) respectively to said coupling plate (16*d*), a second crank (9) rigidly connected to said fabric take-up roller (1), one of said first coupling links (8) providing an articulating connection (8*a*, 8*b*) between said second crank (9) and said coupling plate (16*d*), whereby said first and second motion transmission couplings (4, 11) are connected to said fabric take-up roller (1) through said coupling plate (16*d*).

BRIEF DESCRIPTION OF THE DRAWINGS

In order that the invention may be clearly understood it will now be described in connection with example embodiments, with reference to the accompanying drawings, wherein.

DETAILED DESCRIPTION OF A PREFERRED EXAMPLE EMBODIMENT AND OF THE BEST MODE OF THE INVENTION

The drive for performing a so-called fabric shifting is normally derived from the main drive shaft of the weaving loom for forming a predetermined pile height when weaving terry fabric. For this purpose a so-called terry fabric eccentric cam is used. A cam follower travels along the eccentric contour of the cam and transmits the motion onto a motion transmission coupling for shifting the fabric.

Figure 1:
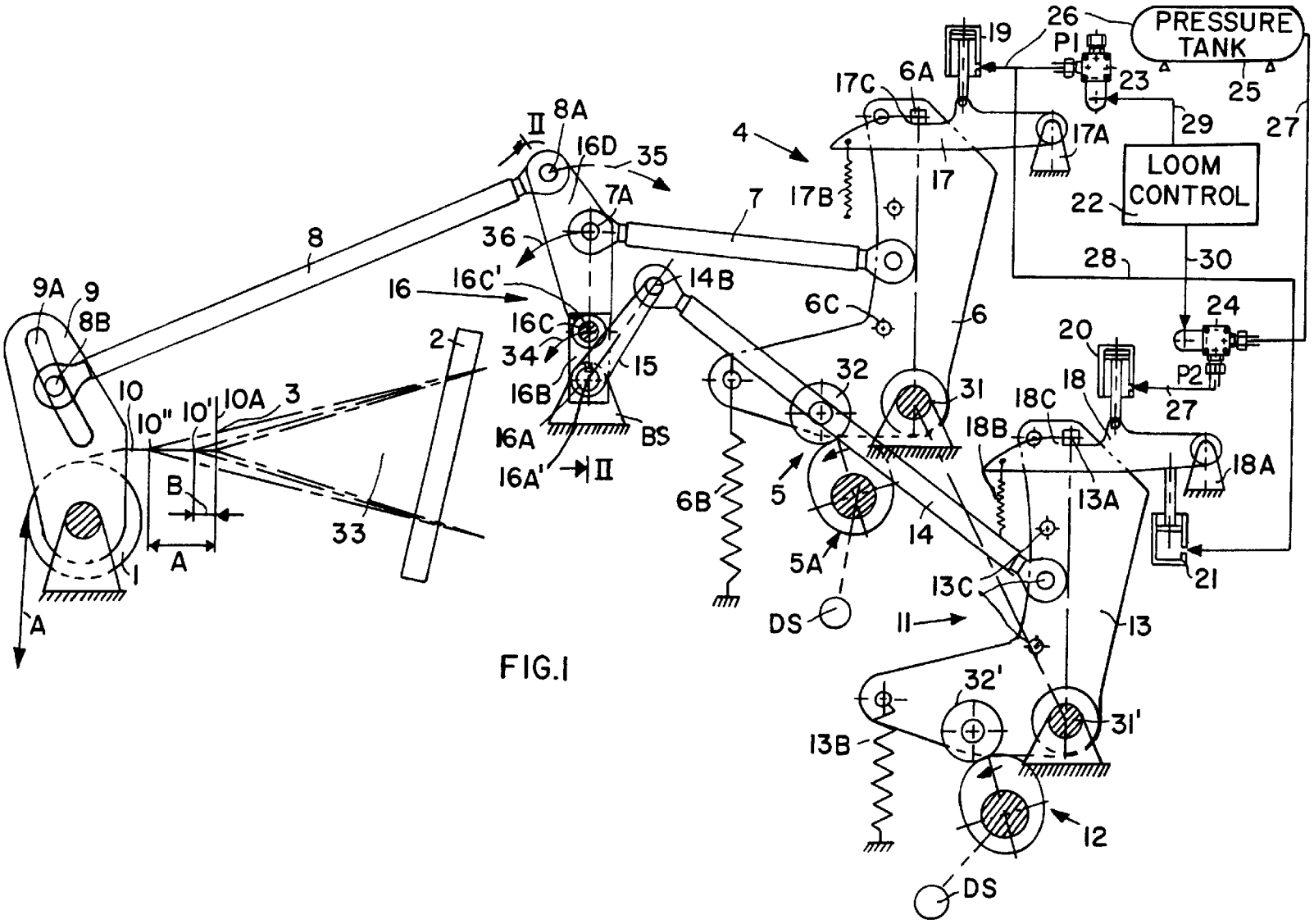
FIG. 1 is a schematic side view of the improvement according to the invention for a terry fabric weaving loom showing the operation of two motion transmission couplings driven through the main loom drive shaft and the control of both couplings through the main loom control.

Referring to FIG. 1 the apparatus according to the invention comprises a first power or motion transmission coupling 4 and a second power or motion transmission coupling 11. Each coupling 4 and 11 is controlled by the loom control 22 through first and second controllable valves 23 or 24 respectively for operating a blocking mechanism 17, 17A and 19 for the first coupling 4 and another blocking mechanism 18, 18a and 20 for the second coupling 11.

The first coupling 4 comprises a coupling bellcrank 6 journalled on an axle 31 which is mounted in the loom frame in a fixed position. The bellcrank 6 has a first arm carrying a cam follower roller 32 spaced from the journal axle 31. The cam follower roller 32 is positioned for engaging a circumferential surface 5*a* of an eccentric cam drive 5 which is driven by a main loom drive shaft DS. A stop element 6*a* is secured to the other arm of the bellcrank 6. A tension spring 6*b* is connected between the machine frame and the free end of the first arm of the bellcrank 6 to keep the cam follower roller 32 in engagement with the surface 5*a* of the drive cam 5. The first arm of the bellcrank 6 extends, for example, approximately horizontally as shown in FIG. 1.

The other arm of the bellcrank lever 6 is provided with a plurality of pivoting or journalling positions 6*c* located on a circle that has its center in a journal axis 7*a* of a coupling link 7 of the first coupling 4. The right-hand end of the coupling link 7 can be selectively journalled in any one of the journal positions 6*c*. Each of these different journal positions 6*c* defines a first length or pile length "a". The other end of the coupling link 7 is journalled in the journal or pivot point 7*a* in a coupling plate 16*d* forming part of a motion superimposing mechanism to be described in more detail below with reference to FIG. 2. The journal point 7*a* is positioned on the coupling plate 16*d* intermediate two journals 8*a* and 16*c*.

Figure 2:
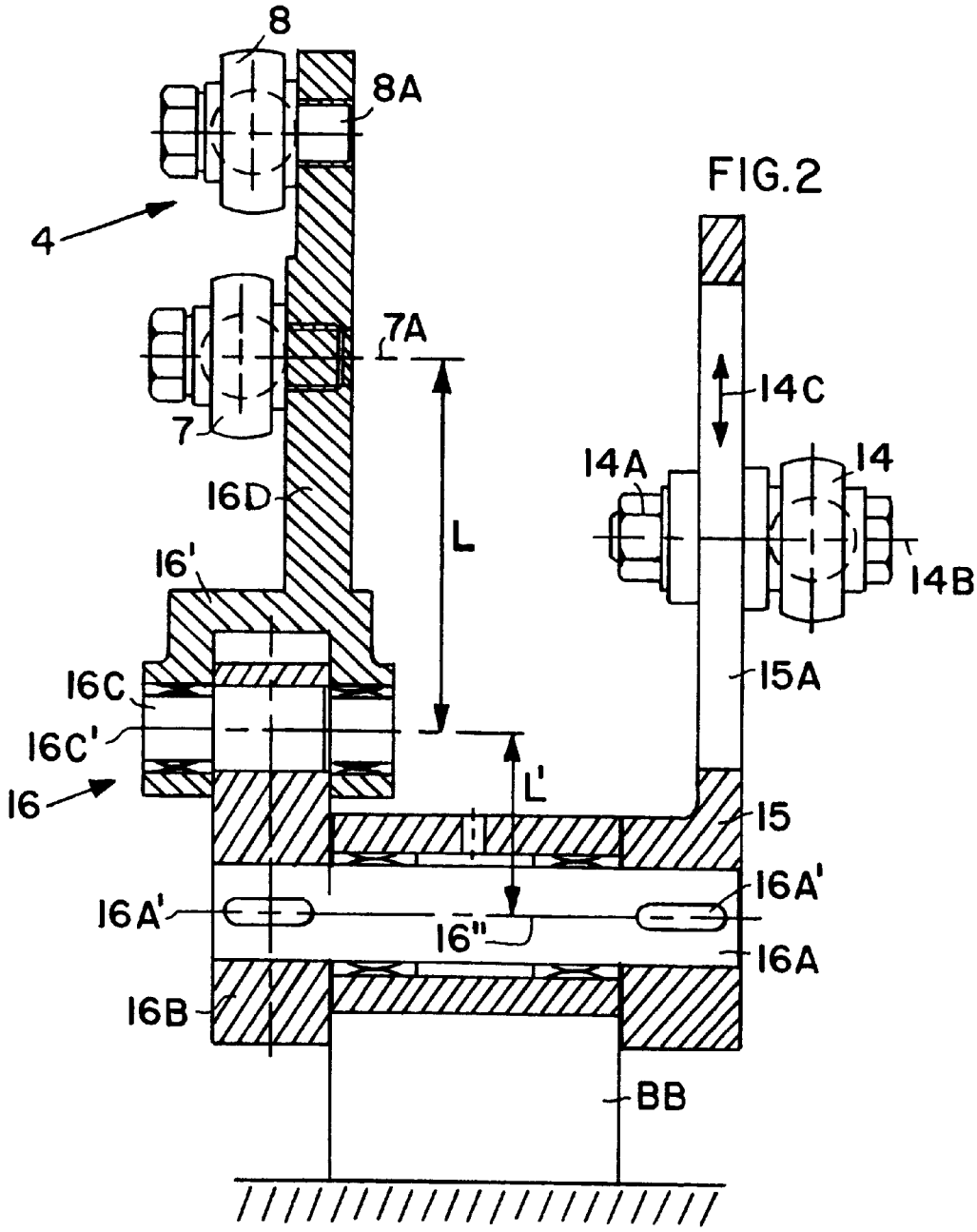
FIG. 2 is a sectional view along section line II—II in FIG. 1 to show the relative dimensions of the motion superimposing mechanism for superimposing the second oscillating motion on the first oscillating motion for changing the amplitude of the back and forth motion of the fabric take-up roller.

As shown in FIG. 2, the coupling plate 16*d* has a forked end 16' that is journalled to a journal axle 16*c* providing a rotation axis 16*c*' for the coupling plate 16*d*. The axle 16*c* is rigidly secured to a lever arm 16*b* which in turn is rigidly secured to journal axle 16*a* that is rotatably mounted in a bearing block BB secured to the loom frame. Tongues 16*a*' prevent relative rotation between the axle 16*a* and the lever arm 16*b*. A crank is 15 journalled at 14*b* to a coupling link 14 which in turn is journalled at 13*c* (FIG. 1) to the second motion transmission coupling 11.

As shown in FIG. 2, the crank 15 has a slot 15*a* in which the position of the journal axis 14*b* is adjustable when the nut 14*a* is loosened. The adjustment can be made up and down as indicated by the arrow 14*c*. Once the journal axis 14*b* is in the proper position, the nut 14*a* is tightened again but leaving the end of the link 14 free to journal about the axis 14*b*.

As described, the coupling plate 16*d* is tiltable about the journal axis 16*c*' which has a fixed on-center spacing L from the journal axis 7*a*. Further, the journal axis 16*c*' has an on-center spacing L' from the journal axis 16" of the axle 16*a*. These fixed on-center spacings L and L' determine the reduction of the above mentioned first pile length "a" to a second pile length "b", when the second motion transmission coupling 11 is switched on and its motion is superimposed on the first motion transmission 4 through the mechanism 16. The superimposing is accomplished because the motion of the crank 15 is transmitted through the axle 16*a* to the crank arm 16*b* which shifts the journal axis 16*c*' of the coupling plate 16*d* to which both links 7 and 8 are journalled.

Referring further to FIGS. 1 and 2 in conjunction, the coupling plate 16*d* of the superimposing mechanism 16 comprises a further journal axis 8*a* to which the coupling link 8 is journalled or pivoted for connecting the mechanism 16 to a crank arm 9 provided with a slot 9*a* in which the journal 8*b* is adjustable and fixable in an adjusted position. The crank arm 9 is rigidly connected to a fabric take-up roller 1 that takes up terry fabric 10 in the direction of the arrow A. Thus, the power train from the cam 5*a* driven through the main loom drive shaft DS, is complete through the bellcrank 6, the coupling link 7, the coupling plate 16*d*, the coupling link 8, and the crank arm 9, whereby the motion of the motion transmission coupling 4 is transmitted to the take-up roller 1 for the formation of a first pile with the pile length "a".

According to the invention, the second motion transmission coupling 11 is driven by a terry fabric cam drive 12 which in turn derives its power from the main loom drive shaft DS. The motion of the second coupling 11 is superimposed on the motion of the first coupling 4 through the mechanism 16. A bellcrank 13 of the second motion transmission coupling 11 is constructed substantially in the same manner as the bellcrank 6. One arm of the bellcrank 13 is carrying a cam follower roller 32' that engages the circumference of the cam 12 and a spring 13*b* connected at one end to the free end of the one arm of the bellcrank 13 and at the other end to the machine frame keeps the cam follower roller 32' engaged with the cam 12. The bellcrank 13 is journalled to a journal axis 31' which in turn is fixed to the machine frame. The journal axles 31 and 31' may, for example be provided in common for both bellcranks 6 and 13. The oscillating motion of the bellcrank 13 is transmitted through a coupling link 14 to the crank 15. The link 14 is journalled to the crank 15 at 14*b* as described above, and to the bellcrank 13 at 13*c*, whereby again several selectable journal points 13*c* are provided on a circle in the upwardly extending arm of the bellcrank 13. The motion of the bellcrank 13 can also be selectively superimposed on the motion of the bellcrank 6 and superimposed on the motion of the bellcrank 6 and transmitted to the fabric take-up roller 1 through the coupling link 14, the crank arm 15, the lever arm 16*b*, the coupling plate 16*d*, the link 8, and the crank arm 9.

Referring to FIG. 1, each motion transmission coupling 4 and 11 is provided with its own blocking mechanism. The blocking mechanism for the bellcrank 6 comprises a lever 17, one end of which is journalled to a journal bearing 17*a* while the other end of the lever 17 is connected through a tension spring 17*b* to the machine frame for normally disengaging a shoulder 17*c* of the lever 17 from the stop element 6*a* of the bellcrank 6. The bellcrank 6 is blocked or arrested by engaging the shoulder 17*c* with the stop element 6*a* of the bellcrank 6. For this purpose a piston cylinder device 19 that is activated to move the lever 17 clockwise into the locked position shown in FIG. 1. The device 19 is operated through the first controllable valve 23 that is, for example, a pneumatic valve which receives pressurized air from a pressure tank 25 through a conductor such as a pressure hose 26. The valve 23 may be, for example, operated electro-mechanically by energizing a solenoid controlled through the loom control 22 through an electrical conductor 29. When the piston cylinder device 19 is not pressurized, the spring 17*b* will disengage the blocking lever 17 from its blocking position shown in FIG. 1 to permit the first coupling 4 to transmit its motion from the cam drive 5 to the fabric take-up roller 1 as described.

The blocking mechanism for the second transmission 11 is substantially identical to the one described above. A blocking lever 18 is journalled to a journal 18*a* mounted in the machine frame. The other end is biased by a tension spring 18*b* which disengages a blocking shoulder 18*c* from a blocking member 13*a* of the bellcrank 13 when a piston cylinder device 20 is not activated. The piston cylinder device 20 is controlled through the second controllable valve, for example an electromagnetic valve 24 connected to the loom control 22 through an electrical conductor 30. The valve 24 receives pressurized air through a conduit 27 from the tank 25.

According to a further embodiment of the invention the two motion transmission couplings 4 and 11 are equipped with a pneumatic safety mechanism comprising a piston cylinder device 21 additionally connected to the blocking lever 18 as seen in FIG. 1. The piston cylinder device 21 is connected through a pressure conduit or pressure hose 28 to the output of the control valve 23, whereby control valve 23 controls the operation of the piston cylinder devices 19 and 21 in unison. This feature makes sure, that the coupling 11 cannot be effective unless the coupling 4 is unlocked. Stated differently, the motion sequence of the coupling 11 can be superimposed on the motion sequence of the coupling 4 only when both couplings 4 and 11 are unlocked.

The operation for superimposing the motion of the second coupling 11 on the motion of the first coupling 4 will now be described with particular attention to the superimposing mechanism 16. The weft beat-up line 10*a* of the terry fabric 10 is shown in its base position 3. The reed 2 is shown also in its base position away from the beat-up position with the loom shed 33 in its open position. The shifting of the beat-up line 10*a* into positions 10' and 10" which are spaced by the length "b" and the length "a" respectively from the baseline 3 will now be described by reference to FIGS. 1 and 2 in conjunction.

When both motion transmission couplings 4 and 11 are blocked as shown in FIG. 1, the loom can perform a so-called smooth weaving.

When the transmission 11 is blocked, and only the transmission 4 is active (not blocked), the eccentric cam drive 5 drives the transmission 4 and the coupling elements 6 and 7 transmit the motion to the coupling plate 16*d* which thereby tilts about the journal axis 16*c*' of the axle 16, thereby transmitting the tilting motion through the elements 8 and 9 onto the fabric take-up roller 1, whereby the beat-up line 10*a* is shifted by the length "a" from the base position 3 into the position 10". This motion or oscillation is indicated by the arrow 36 in FIG. 1. On the return motion as indicated by the arrow 35, the beat-up line 10*a* is brought back into the base position 3. During this return motion of the beat-up line 10*a* the reed 2 performs a full beat-up of the weft thread inserted into the shed 33, whereby the warp threads are looped or raised by the length "a" forming the pile length "b". If a second pile length is to be formed whereby the pile length "b" is preferably smaller than the length "a", the motion sequence of the second coupling 11 is superimposed on the motion sequence of the first coupling 4 in response to a control signal from the loom control 22 as described above.

Figure 3:
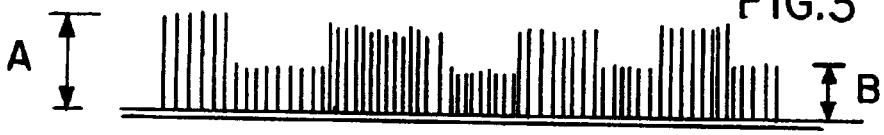
FIG. 3 shows schematically two different pile lengths in the same terrycloth.

The shoulder 18*c* is disengaged from the blocking element 13*a* for superimposing the motion of the coupling 11 on the motion of the coupling 4. The oscillating motion derived from the drive 12 is transmitted through the elements 13, 14, 15, 16*b* to the coupling plate 16*d*, whereby the journal axis 16*c*' of the plate 16*d* is shifted to the left as indicated by the arrows 34 in FIG. 1. Simultaneously, the journal axis 8*a* is shifted to the right as indicated by the arrow 35, thereby reducing the reach of the coupling link 8. As a result, the beat-up line 10*a* of the fabric 10 is shifted only in an oscillating motion by the length "b", thereby providing a second pile length corresponding approximately to the length "b". FIG. 3 shows the two different piles having the pile lengths corresponding approximately to the length "a" and "b", respectively.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for weaving terry fabric having selectively first and second different pile lengths, comprising the following steps:

(a) performing a first weaving motion sequence of first weaving steps including weft thread beat-up motions;

(b) first shifting a movable weft beat-up line (10*a*) of said terry fabric (10) during said first motion sequence by imposing first oscillating back and forth motions on said terry fabric (10) relative to a beat-up base line (3) between said first weaving steps;

(c) controlling an amplitude of said first oscillating back and forth motions to form a first shifting length (a) which provides a respective first pile length;

(d) performing a second weaving motion sequence of second weaving steps including weft thread beat-up motions;

(e) second shifting said movable weft beat-up line (10*a*) of said terry fabric (10) by imposing second oscillating back and forth motions on said terry fabric (10) relative to said beat-up base line (3) between said second weaving steps;

(f) further controlling an amplitude of said second oscillating back and forth motions to form a second shifting length (b) which provides a respective second pile length; and (g) superimposing said second weaving motion sequence on said first weaving motion sequence for producing said two different pile lengths.

2. The method of claim 1, further comprising driving said first weaving motion sequence through a first motion transmission coupling (4) driven by a first eccentric drive (5), driving said second weaving motion sequence through a second motion transmission coupling (11) controlled by a second eccentric drive (12) and performing said superimposing step by operatively coupling said first eccenter drive (4) and said second eccenter drive (11) with each other.

3. The method of claim 2, further comprising performing said step of operatively coupling through a central loom control (22) and through pneumatic drives (19, 23; 20, 24) to selectively activate and deactivate said first and second motion transmission couplings (4, 11) for selectively performing said superimposing step (g).

4. The method of claim 1, further comprising controlling said first weaving motion sequence and said second weaving motion sequence in their respective amplitudes so that said first pile length (a') is longer than said second pile length (b').

5. The method of claim 1, further comprising blocking said second weaving motion sequence for forming said first pile length (a') during said first weaving motion sequence.

6. The method of claim 1, further comprising forming said second pile length (b') by simultaneously performing said first and second weaving motion sequences.

7. The method of claim 1, further comprising blocking or disabling said first and second weaving motion sequences for enabling a smooth weaving operation.

8. The method of claim 7, further comprising performing said smooth weaving operation for weaving smooth borders for said terry fabric.

9. The method of claim 1, further comprising including in each of said first and second weaving motion sequences, groups of weaving steps each group including a number of partial weft thread beat-up motions and at least one full weft thread beat-up motion, and performing said first and second shifting of said terry fabric between groups of steps.

10. A terry fabric weaving loom, said weaving loom comprising in combination a main loom drive shaft (DS), a rotatably mounted fabric take-up roller (1), a reed (2) for performing full and partial weft beat-up motions, a first motion transmission coupling (4), a first eccentric cam drive (5) driven through said main loom drive shaft (DS) and operatively connected to said first motion transmission coupling (4), first coupling links (7, 8, 9) linking said first motion transmission coupling (4) to said take-up roller (1) for shifting a movable weft beat-up line (10*a*) of said terry fabric (10) relative to a beat-up base line (3) back and forth by a first shifting length (a) which provides a respective first pile length, said apparatus further comprising a second motion transmission coupling (11), a second eccentric cam drive (12) driven through said main loom drive shaft (DS) and operatively connected to said second motion transmission coupling (11), a motion superimposing mechanism comprising second coupling links (14, 15, 16) linking said second motion transmission coupling (11) to said first power transmission coupling (4) for superimposing motions of said second motion transmission coupling (11) on motions of said first motion transmission coupling (4) so that said fabric take-up roller (1) shifts said movable beat-up line (10*a*) relative to said beat-up base line (3) back and forth by a second shifting length (b), said second length (b) providing a respective different pile length when said first and second lower transmission couplings are actively driven by said first and second eccentric cam drives (5, 12).

11. The loom of claim 10, wherein said second coupling links (14, 15, 16) of said motion superimposing mechanism linking said second motion transmission coupling (11) to said first motion transmission coupling (4) comprise a fixed bearing support (BS), an axle (16*a*) journalled in said fixed bearing support, a crank (15) rigidly secured to said axle (16*a*) and articulated at its other end to said second coupling link (14), a first lever arm (16*b*) having a first end rigidly secured to said axle (16*a*), a coupling plate (16*d*), a journal (16*c*) pivoting said lever arm (16*b*) to said coupling plate (16*d*), and further journals (7*a*, 8*a*) journalling said first coupling links (7, 8) respectively to said coupling plate (16*d*), a second crank (9) rigidly connected to said fabric take-up roller (1), one of said first coupling links (8) providing an articulating connection (8*a*, 8*b*) between said second crank (9) and said coupling plate (16*d*), whereby said first and second motion transmission couplings (4, 11) are connected to said fabric take-up roller (1) through said coupling plate (16*d*).

12. The loom of claim 10, further comprising a first stop element (6*a*) for blocking an operation of said first motion transmission coupling (4) and a second stop element (13*a*) for blocking said second power transmission coupling (11), a first blocking lever (17) and a first power drive (19) connected to said first blocking lever (17 for moving said first blocking lever (17) into and out of cooperation with said first stop element (6*a*) in response to a control signal, a second blocking lever (18) and a second power drive (20) connected to said second blocking lever (18) for moving said second blocking lever into and out of cooperation with said second stop element (13*a*) in response to a respective control signal.

13. The loom of claim 12, wherein said first power drive (19) and said second power drive (20) comprise respective pneumatic piston cylinder devices and a source of pneumatic pressure (25), pressure conduits (26, 27) operatively connecting said source of pneumatic pressure (25) to said piston cylinder devices, first and second controllable valves (23, 24) in said pressure conduits (26, 27), a loom control (22) and control conductors (29, 30) connecting said loom control (22) to said first and second controllable valves (23, 24) for selectively operating said pneumatic piston cylinder devices (19, 20) through said first and second controllable valves (23, 24).

14. The loom of claim 13, wherein said first and second controllable valves (23, 24) are electromagnetic valves which are connected at an input port to said source of pneumatic pressure (25) and at an output port to said piston cylinder devices (19, 20) by said pressure conduits (26, 27).

15. The loom of claim 13, further comprising a third piston cylinder device (21) connected to said second blocking lever (18) of said second power transmission coupling (11), and a pneumatic power conduit (28) connecting a pressure output port (P1) of said first controllable valve (23) to said third piston cylinder device (21), whereby said first power drive (19) and said third power drive (21) are operated through said first controllable valve (23), whereby said second motion transmission coupling (11) is operable only if said first motion transmission coupling (4) is operable.

* * * * *